US009095006B2

(12) United States Patent
Yue

(10) Patent No.: US 9,095,006 B2
(45) Date of Patent: Jul. 28, 2015

(54) ELECTRIC HEATING APPARATUS

(71) Applicant: Steven Yue, Taipei (TW)

(72) Inventor: Steven Yue, Taipei (TW)

( * ) Notice: Subject to any disclaimer, the term of this patent is extended or adjusted under 35 U.S.C. 154(b) by 255 days.

(21) Appl. No.: 13/665,757

(22) Filed: Oct. 31, 2012

(65) Prior Publication Data

US 2013/0105464 A1 May 2, 2013

(30) Foreign Application Priority Data

Nov. 2, 2011 (TW) ..... 100139992 A

(51) Int. Cl.
*H05B 1/02* (2006.01)
*H05B 3/20* (2006.01)

(52) U.S. Cl.
CPC ..... *H05B 3/20* (2013.01); *H05B 2203/003* (2013.01); *H05B 2203/005* (2013.01); *H05B 2203/012* (2013.01); *H05B 2203/014* (2013.01)

(58) Field of Classification Search
CPC ..... H05B 2203/005; H05B 2203/012; H05B 2203/014; H05B 2203/016; H05B 1/0202; H05B 1/02
USPC ..... 219/483, 482, 485, 486, 490, 508, 509
See application file for complete search history.

(56) References Cited

U.S. PATENT DOCUMENTS

| | | | | | |
|---|---|---|---|---|---|
| 4,328,676 | A | * | 5/1982 | Reed | 62/3.62 |
| 4,990,752 | A | * | 2/1991 | Worrall et al. | 219/501 |
| 5,105,067 | A | * | 4/1992 | Brekkestran et al. | 219/497 |
| 5,293,447 | A | * | 3/1994 | Fanney et al. | 392/449 |
| 5,576,512 | A | | 11/1996 | Doke | |
| 6,037,571 | A | * | 3/2000 | Christopher | 219/450.1 |
| 6,080,971 | A | * | 6/2000 | Seitz et al. | 219/483 |

FOREIGN PATENT DOCUMENTS

| | | | |
|---|---|---|---|
| GB | 783261 | A | 9/1957 |
| TW | M330670 | U | 4/2008 |

* cited by examiner

*Primary Examiner* — Mark Paschall
(74) *Attorney, Agent, or Firm* — Holland & Hart LLP

(57) ABSTRACT

An electric heating apparatus includes a power module, an electric heating unit, and a switching unit. The power module is adapted to be electrically connected to a battery for outputting electric energy. The electric heating unit includes multiple electric heating components electrically connected to the power module tor receiving and converting the electric energy into thermal energy. The switching unit is electrically connected between the power module and the electric heating unit, and is operable to control electrical connection between the power module and each of the electric heating components. Accordingly, the electric heating unit generates the thermal energy with a constant output power.

5 Claims, 7 Drawing Sheets

ELECTRIC HEATING APPARATUS

CROSS-REFERENCE TO RELATED APPLICATION

This application claims priority of Taiwanese Patent Application No. 100139992, filed on Nov. 2, 2011.

BACKGROUND OF THE INVENTION

1. Field of the Invention

This invention relates to an electric heating apparatus, more particularly to an electric heating apparatus capable of converting electric energy from various batteries having different voltages into thermal energy.

2. Description of the Related Art

FIGS. 1 and 2 show a conventional electric heating apparatus that includes a control box 940 and a heating wire 913 electrically connected to the control box 940.

The heating wire 913 is bent to form several segments for uniformly heating an area. The heating wire 913 may be replaced by a different type of electric heating component in the form of a tube or a block.

The control box 940 is adapted to receive a battery set 930, and includes a switch 921 and a temperature control unit 922. The switch 921 is user-operable for starting up the conventional electric heating apparatus. The temperature control unit 922 is capable of detecting temperature of the heating wire 913, and providing an electric current from the battery set 930 to the heating wire 913 according to the detected temperature. When the switch 921 is switched on, the electric current is provided from the battery set 930 and flows through the heating wire 913 such that the heating wire 313 can convert electric energy into thermal energy.

However, the conventional electric heating apparatus may not accept batteries of various sizes and having different voltages. In other words, the conventional electric heating apparatus may only use a particular sized battery having a particular voltage.

A thermoelectric apparatus disclosed in U.S. Pat. No. 5,576,512 is compatible with multiple power sources each providing a different voltage. The thermoelectric apparatus includes a sensing circuitry, a parallel connection circuitry, a serial connection circuitry, and thermoelectric devices. The sensing circuitry is capable of detecting whether the power source provides a lower operating voltage or a higher operating voltage. For the lower operating voltage, the thermoelectric devices are electrically connected to one another in parallel through the parallel connection circuitry. For the higher operating voltage, the thermoelectric devices are configured in series through the serial connection circuitry. As a result, the thermoelectric apparatus is switchable between a full heating mode, where the thermoelectric devices are in the parallel connection, and a half heating mode where the thermoelectric devices are in the series connection.

However, circuits of the thermoelectric apparatus as described above are complicated. Furthermore, the thermoelectric apparatus may not generate a constant output power when the power sources have different operating voltages.

SUMMARY OF THE INVENTION

Therefore, the object of the present invention is to provide an electric heating apparatus that is capable of converting electric energy from various batteries having different voltages into thermal energy with a constant output power.

The electric heating apparatus includes a power module, an electric heating unit, and a switching unit. The power module is adapted to be electrically connected to a battery for outputting electric energy. The electric heating unit includes a plurality of electric heating components electrically connected to the power module for receiving and converting the electric energy into thermal energy. The switching unit is electrically connected between the power module and the electric heating unit. According to voltage of the battery electrically connected to the power module, the switching unit is operable to control electrical connection between the power module and each of the electric heating components so as to allow the electric heating unit to generate the thermal energy with a constant output power.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 1:
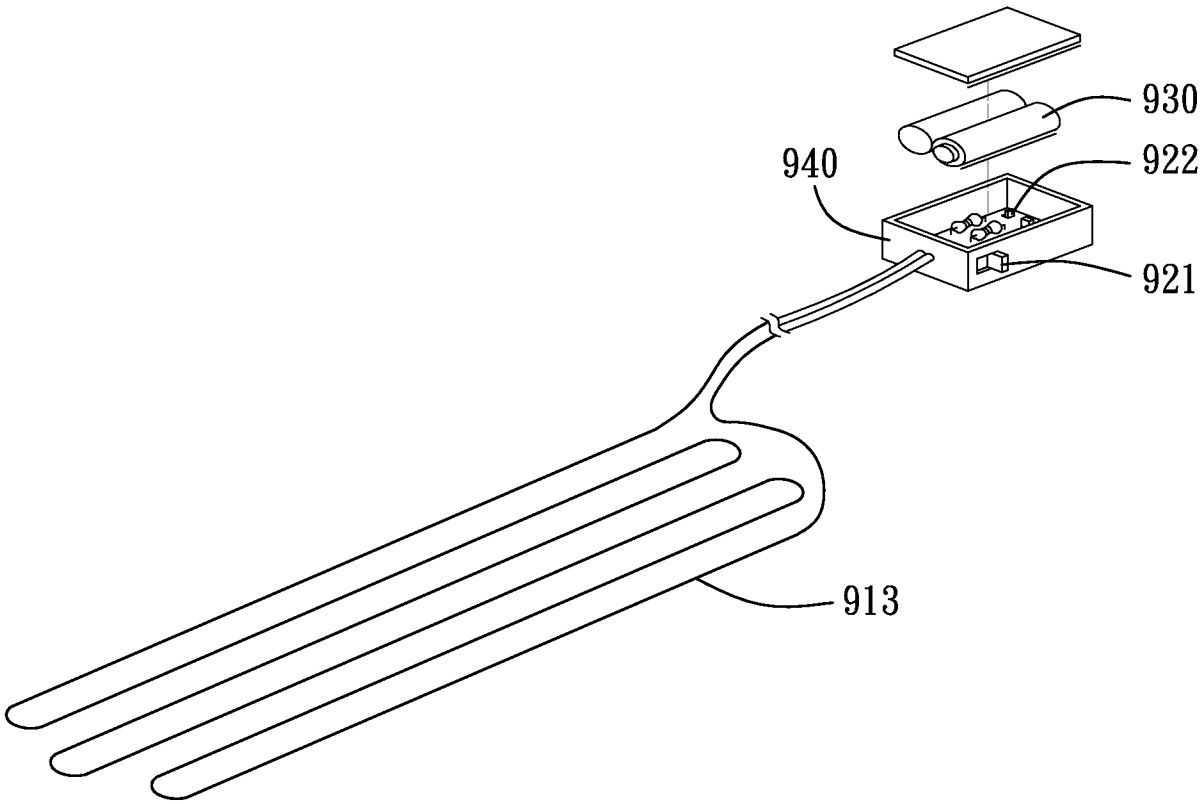
FIG. 1 PRIOR ART
FIG. 1 is a perspective view of a conventional electric heating apparatus.
Figure 2:
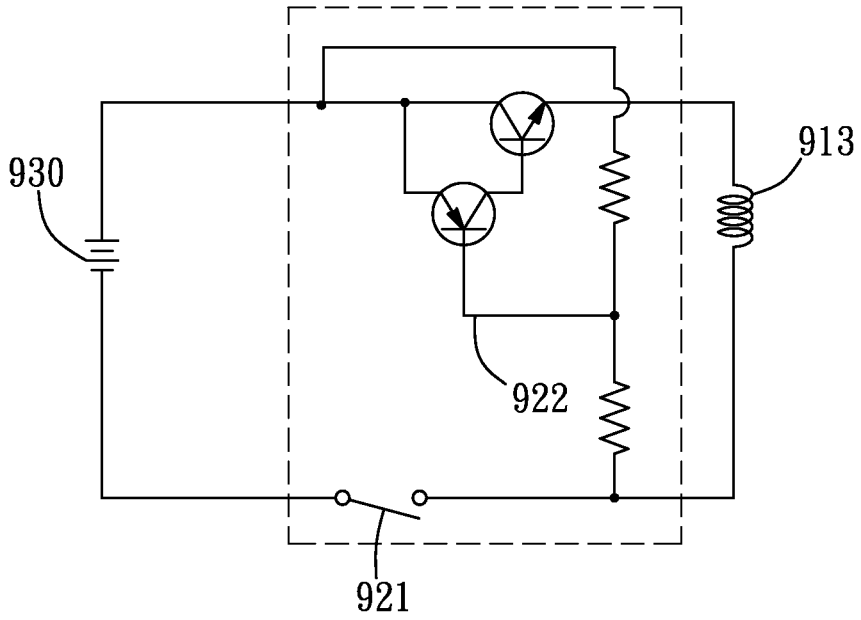
F I G. 2 PRIOR ART
FIG. 2 is a circuit diagram of the conventional electric heating apparatus.

Before the present invention is described in greater detail with reference to the preferred embodiment, it should be noted that the same reference numerals are used to denote the same elements throughout the following description.

Figure 3:
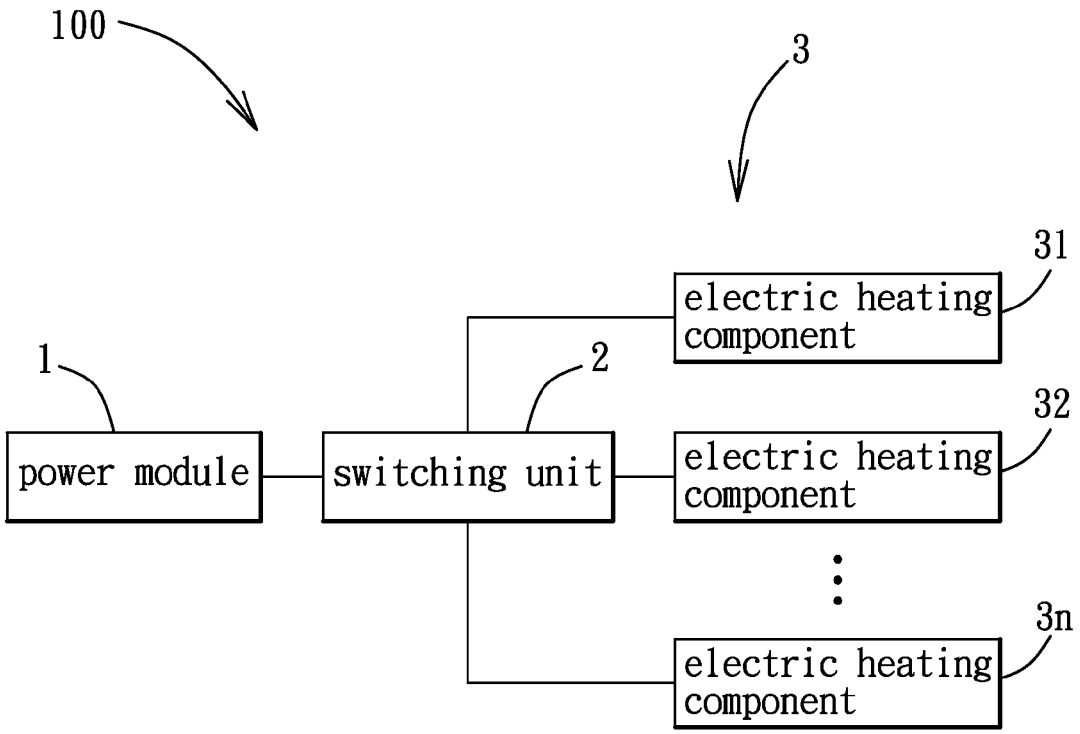
FIG. 3 is a block diagram of a preferred embodiment of an electric heating apparatus according to this invention.

FIG. 3 shows a preferred embodiment of an electric heating apparatus 100 adapted for converting electric energy from various batteries having different voltages into thermal energy with a constant output power. The electric heating apparatus 100 may be applied to an electric heating blanket, an electric heating clothing, a pair of electric heating pants, a pair of electric heating shoes, etc. It should be noted that the constant output power is defined as an output power having plus and minus deviations of about 1 watt, and the variation of the constant output power may not be obviously felt by a user. The electric heating apparatus 100 includes a power module 1, a switching unit 2, and an electric heating unit 3.

The power module 1 is adapted to be electrically connected to a battery for outputting electric energy of the battery in the form of direct current (DC) voltage. Generally, batteries of three primary standards are widely used in electric heating devices and electric power tools, i.e., a battery having a voltage of 7.4 volts, a battery having a voltage of 11.1 volts and a battery having a voltage of 18 volts. For exemplary purposes, the electric heating apparatus 100 of this embodiment is configured to use batteries of these three standards. However, the present invention is not limited to the standard/size/type of the batteries, and other power sources having different voltages may be used without departing from the scope of the present invention.

The electric heating unit 3 includes a plurality of electric heating components 31~3*n* electrically connected to the power module 1 for receiving and converting the electric energy into thermal energy. The switching unit 2 is electrically connected between the power module 1 and the electric heating unit 3. According to the voltage of the battery electrically connected to the power module 1, the switching unit 2 is operable to control electrical connection between the power module 1 and each of the electric heating components 31~3*n* so as to allow the electric heating unit 3 to generate the thermal energy with the constant output power. In practice, each or the electric heating components 31~3*n* may be a heating wire, or other types of electric heating components in the form of a tube or a block.

Figure 4:
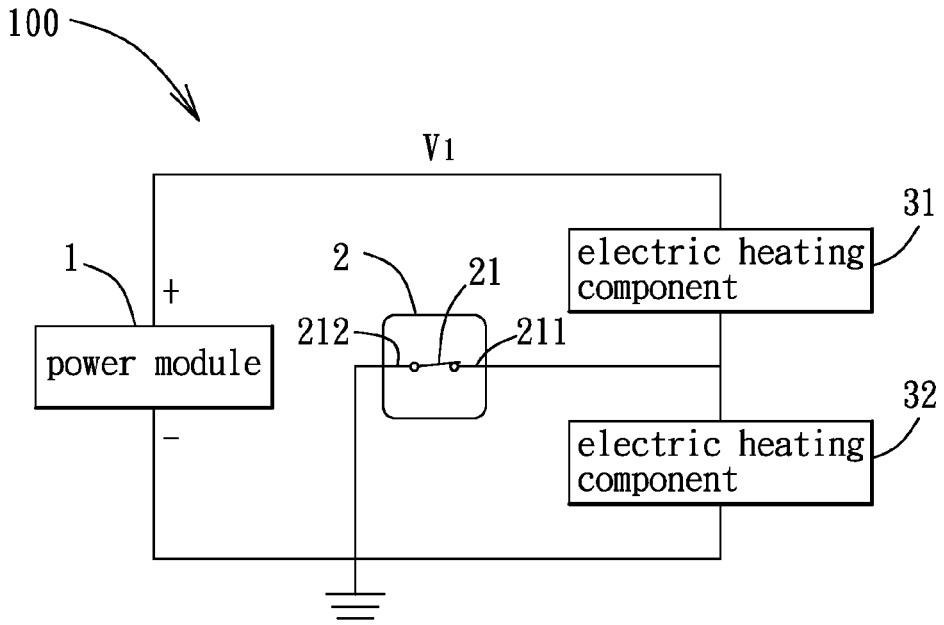
FIG. 4 is a schematic circuit block diagram of a first example of the electric heating apparatus, in which a switching unit is closed to form a short circuit.
Figure 5:
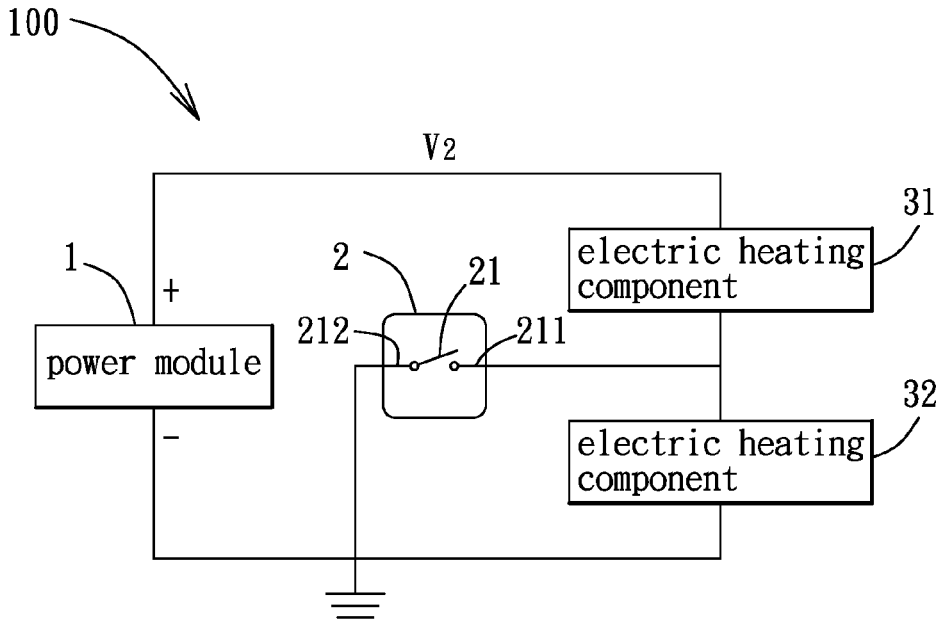
FIG. 5 is a schematic circuit block diagram of the first example of the electric heating apparatus, in which, the switching unit is opened to form an open, circuit.

Referring to FIGS. 4 and 5, a first example of the electric heating apparatus 100 is illustrated. The power module 1 includes an output end (+) for outputting the electric energy of the battery and a ground end (−) that is grounded. In the first example, the electric heating apparatus 100 is adapted to use a battery having a voltage of a first value (V1) (as shown in FIG. 4) or another battery having a voltage of a second value (V2) (as shown in FIG. 5) greater than the first value (V1). The electric heating unit 3 includes a first electric heating component 31 and a second electric heating component 32. The first electric heating component 31 is electrically connected to the output end (+) of the power module 1. The second electric heating component 32 is electrically connected between the first electric heating component 31 and the ground end (−) of the power module 1 in series.

In the first example, the switching unit 2 includes a first switching component 21 having a first end 211 that is electrically connected between the first and second electric heating components 31, 32, and a second end 212 that is grounded. As shown in FIG. 4, the first switching component 21 is operable to directly ground the first electric heating component 31 so as to bypass the second electric heating component 32 when the output end (+) of the power module 1 outputs the voltage of the first value (V1). Alternatively, as shown in FIG. 5, the first switching component 21 is further operable to disconnect the first electric heating component 31 from the ground so that the first and second electric heating components 31, 32 are in series connection with the power module 1 when the output, end (+) of the power module 1 outputs the voltage of the second value (V2) greater than the first value (V1).

For example, the first value (V1) of the voltage is equal to 1.4 volts, and the second value (V2) of the voltage is equal to 11.1 volts. The resistance of the first electric heating component 31 is 7.4 ohms, and the resistance of the second electric heating component 32 is 9.2 ohms. As shown in FIG. 4, when the output end (+) of the power module 1 outputs the voltage of the battery of equal to the first value (V1) of 7.4 volts, the first switching component 21 is closed so as to directly ground the first electric heating component 31 and to bypass the second electric heating component 32. As a result, the first electric heating component 31 having the resistance of 7.4 ohms generates thermal energy with a first output power of 7.4 watts.

As shown in FIG. 5, when the output end (+) of the power module 1 outputs the voltage of the battery of equal to the second value (V2) of 11.1 volts, the first switching components 21 is opened so as to disconnect the first electric heating component 31 from the ground and so that the first and second electric heating components 31, 32 are in series connection with the power module 1. As a result, the total resistance of the first and second electric heating components 31, 32 is 16.6 ohms, and the first and second electric heating components 31, 32 cooperatively generate thermal energy with a second output power of 7.42 watts approximately equal to the first output power of 7.4 watts.

Figure 6:
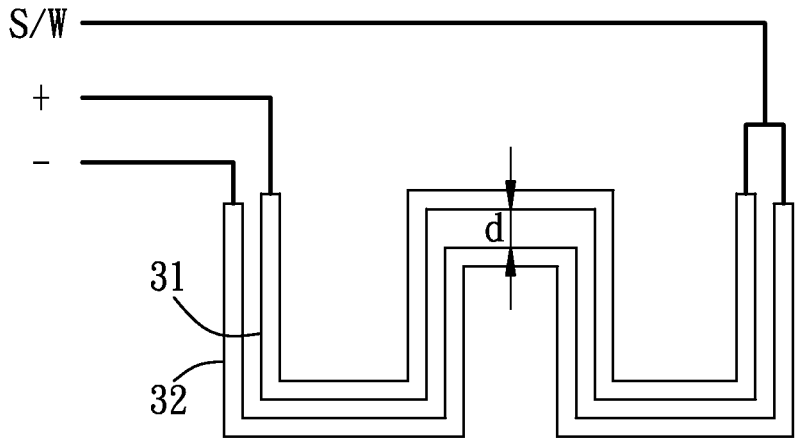
FIG. 6 is a schematic diagram of an exemplary arrangement of electric heating components of the electric heating apparatus.

As shown in FIG. 6, the first and second electric heating components 31, 32 are arranged close together and are parallel to each other. The first and second electric heating components 31, 32 are respectively bent to form, several segments for uniformly heating an area. A distance (d) between the first and second electric heating components 31, 32 is much smaller than a distance between two parallel ones of the segments of each of the first and second electric heating components 31, 32. Alternatively, the first and second electric heating components 31, 32 may adjoin, i.e., the distance (d) is equal to zero. Therefore, no matter which one of the first, and second electric heating components 31, 32 is heated, the user may not feel an apparent difference in temperature at different, portions of the electric heating unit 3.

Figure 7:
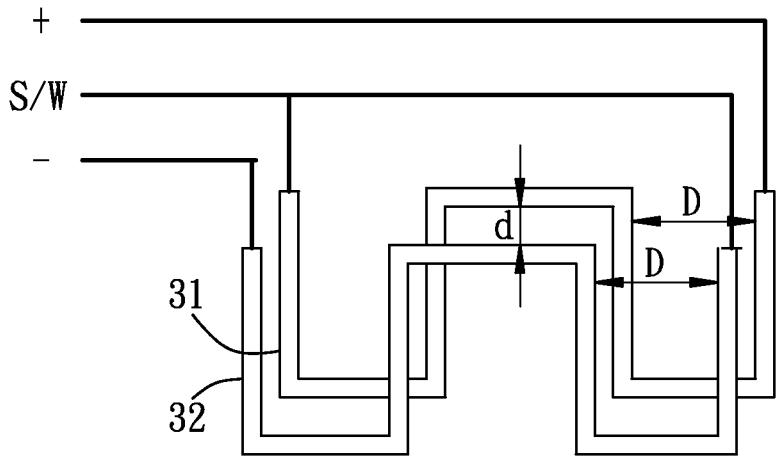
FIG. 7 is a schematic diagram of another exemplary arrangement of the electric heating components of the electric heating apparatus.

As shown in FIG. 7, the first and second electric heating components 31, 32 are arranged close together and partially cross each other. The first and second electric heating components 31, 32 are respectively bent to form several segments that are spaced apart from each other by a distance (D) for uniformly heating an area. A distance (d) between the first and second electric heating components 31, 32 is much smaller than the distance (D), or may even be equal to zero. Therefore, no matter which one of the first and second electric heating components 31, 32 is heated, the user may not feel an apparent difference in temperature at different portions of the electric heating unit 3.

It should be noted that the arrangement of the first and second electric heating components 31, 32 is not limited to the foregoing exemplary arrangements, and those skilled in the art may readily appreciate different arrangements of the first and second electric heating components 31, 32 for achieving the uniform heating effect without departing from the scope of this invention.

Figure 8:
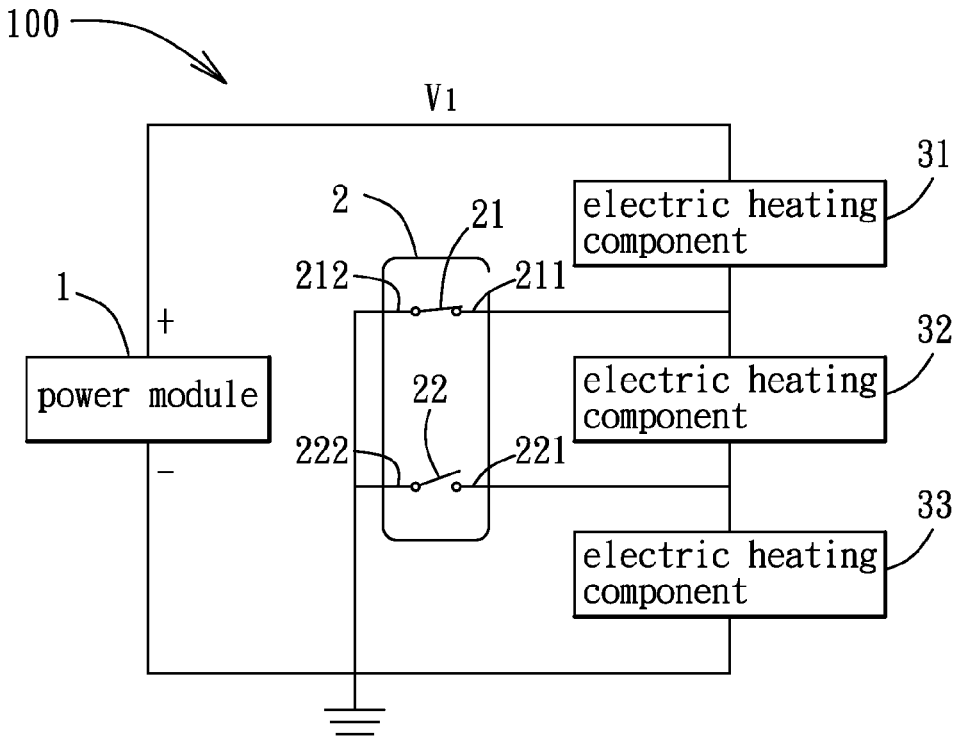
FIG. 8 is a schematic circuit block diagram of a second example of the electric heating apparatus including two switching units and three electric heating components, one of which is used for heating.
Figure 9:
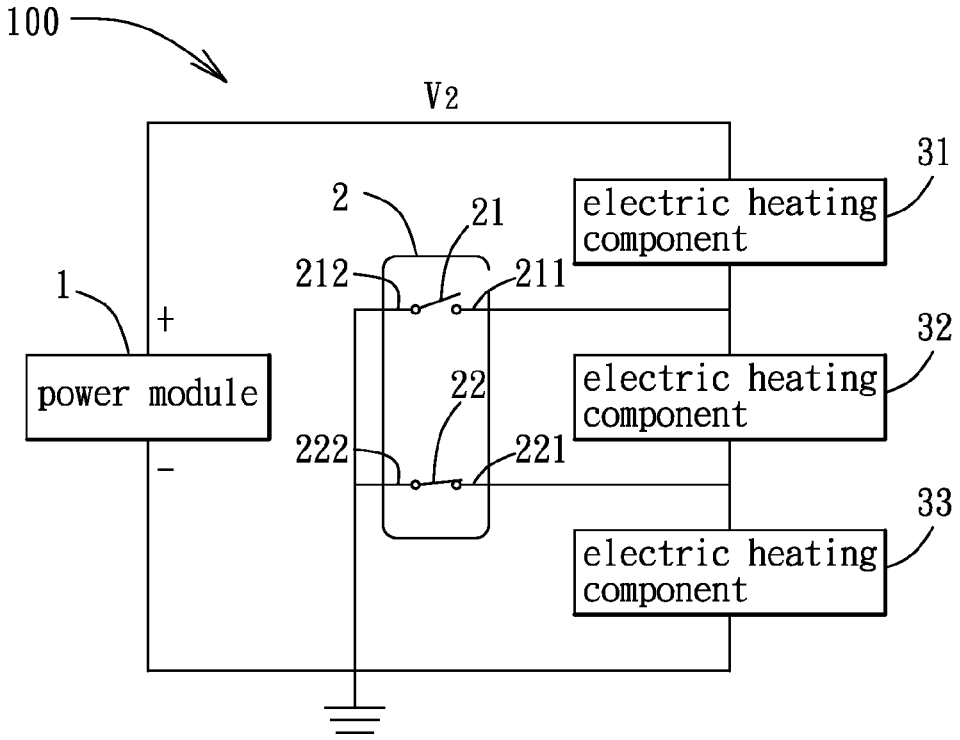
FIG. 9 is another schematic circuit block diagram of the second example of the electric heating apparatus, in which two of three electric heating components are used for heating.
Figure 10:
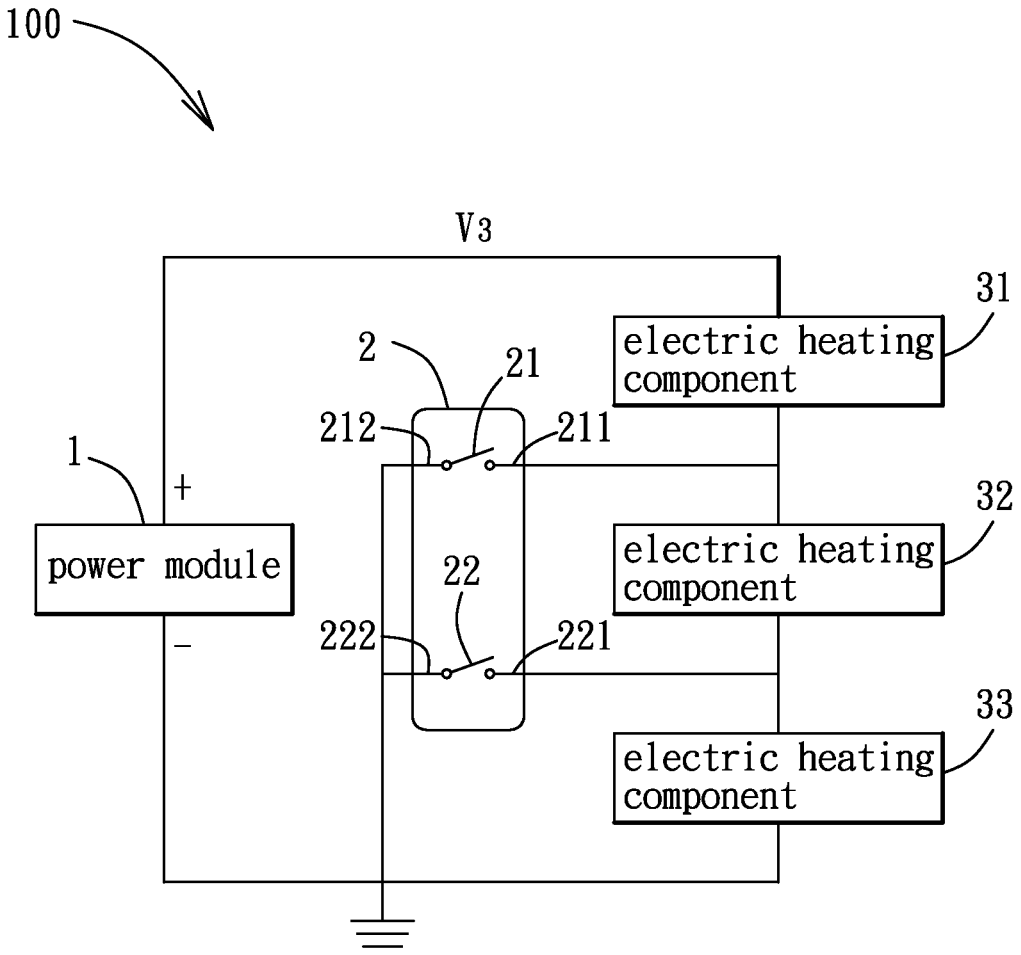
FIG. 10 is still another schematic circuit block diagram of the second example of the electric heating apparatus, in which all of the electric heating components are used for heating.

FIGS. 8 to 10 show a second example of the electric heating apparatus 100 adapted to farther use a battery having a voltage of a third value (V3) greater than the second value (V2). In the second example, the electric heating unit 3 further includes a third electric heating component 33 electrically connected in series between the second electric heating component 32 and the ground end (−) of the power module 1. The switching unit 2 further includes a second switching component 22 having a first end 221 that is electrically connected between the second and third electric heating components 32, 33, and a second end 222 that is grounded. The arrangement of the first, second and third electric heating components 31 to 33 is similar to the exemplary arrangements illustrated in FIGS. 6 and 7.

In the second example, the first electric heating component 31 has a resistance of 7.4 ohms. The second electric heating component 32 has a resistance of 9.25 ohms. The third electric heating component 33 has a resistance of 27 ohms. For example, the first value (V1) of the voltage is equal to 7.4 volts, the second value (V2) of the voltage is equal to 11.1 volts, and the third value (V3) of the voltage is equal to 18 volts. The output end (+) of the power module 1 is adapted to output the first, second and third values (V1~V3), and the electric heating unit 3 is capable of generating thermal energy with an output power of approximately 7.4 watts.

As shown in FIG. 8, when the output end (+) of the power module 1 outputs the voltage of the battery of equal to the first value (V1) of 7.4 volts, the first switching component 21 is closed and the second switching component 22 is opened so as to ground the first electric heating component 31 and to bypass the second and third electric heating components 32, 33. As a result, the first electric heating component 31 having the resistance of 7.4 ohms generates thermal energy with a first output power of 7.4 watts.

As shown in FIG. 9, when the output end (+) of the power module 1 outputs the voltage of the battery of equal to the second value (V2) of 11.1 volts, the first switching component 21 is opened and the second switching component 22 is closed so as to bypass the third electric heating component 33 and so that the first and second electric heating components 31, 32 are in series connection with the power module 1. As a result, the total resistance of the first electric heating component 31 and the second electric heating component 32 is 16.65 ohms (7.4+9.25=16.65), and the first and second electric heating components 31, 32 cooperate to generate thermal energy with a second output power of 7.4 watts.

As shown in FIG. 10, when the output end (+) of the power module 1 outputs the voltage of the battery of equal to the third value (V3) of 18 volts, the first and second switching components 21, 22 are opened so as that the first, second and third electric heating components 31~33 are in series connection with the power module 1. As a result, the total resistance of the first, second and third electric heating components 31~33 is 43.65 ohms (7.4+9.25+27=43.65), and the first, second and third electric heating components 31~33 cooperate to generate thermal energy with a third output power of 7.42 watts.

To sum up, the advantages of this invention are described as follows:

1. According to the voltage of the battery electrically connected to the power module 1, the electric heating apparatus 100 is capable of generating thermal energy with a constant output power by virtue of the switching unit 2 controlling the electrical connection between the power module 1 and each of the electric heating components 31~3*n*.

2. The electric heating apparatus 100 according to this invention is adapted to use batteries of various sizes and having different voltages. Therefore, the user of the electric heating apparatus 100 does not need to prepare a battery with a particular size and may use a currently available battery in the electric heating apparatus 100.

3. By controlling the total resistance of the electric heating unit 3, the electric heating unit 3 may generate thermal energy with a constant output power. Due to the constant output power, the problems of overheating and damaging the battery may be alleviated.

4. The electric heating apparatus 100 is implemented using relatively simple electric circuits without active components. Therefore, the electric energy would not be wasted on active components, and the electric heating apparatus 100 may have a relatively high heating efficiency.

5. The compact arrangement of the electric heating components 31~3*n* facilitates uniform heating by the electric heating unit 3 over an area. Therefore, the user may not feel apparent differences in temperature at different portions of the electric heating unit 3 when the electric heating apparatus 100 uses batteries of different sizes.

While the present invention has been described in connection with what is considered the most practical and preferred embodiment, it is understood, that this invention is not limited to the disclosed embodiment but is intended to cover various arrangements included within the spirit and scope of the broadest interpretation and equivalent arrangements.

What is claimed is:

1. An electric heating apparatus adapted for converting electric energy from a battery into thermal energy with a substantially constant output power, said electric heating apparatus comprising:

a power module adapted to be electrically connected to a battery for outputting electric energy, the battery being selected from multiple batteries that respectively have different constant-voltages;

an electric heating unit including a plurality of electric heating components electrically connected to said power module for receiving and converting the electric energy into thermal energy; and a switching unit electrically connected between said power module and said electric heating unit, and being operable, according to the constant-voltage of the battery that is electrically connected to said power module, to control electrical connection among said electric heating components to result in a total resistance of said electric heating components that is positively proportional to the constant-voltage of the battery, such that said electric heating unit generates the thermal energy with a constant output power that is equal to a square of the constant-voltage of the battery divided by the total resistance.

2. The electric heating apparatus as claimed in claim 1, wherein:

said power module includes an output end that is for outputting the electric energy, and a ground end that is grounded;

said electric heating unit includes a first electric heating component electrically connected to said output end of said power module, and a second electric heating component electrically connected in series between said first electric heating component and said ground end of said power module; and said switching unit includes a first switching component having a first end that is electrically connected between said first and second electric heating components and a second end that is grounded, and being operable to directly ground said first electric heating component so as to bypass said second electric heating component when the constant-voltage of the battery electrically connected to said power module is equal to a first value, and to disconnect said first electric heating component from ground so that said first and second electric heating components are in series connection with said power module when the constant-voltage of the battery electrically connected to said power module is equal to a second value greater than the first value.

3. The electric heating, apparatus as claim in claim 2, wherein:

said electric heating unit further includes a third electric heating component electrically connected in series between said second electric heating component and said ground end of said power module;

said switching unit, further includes a second switching component having a first end that is electrically connected between said second and third electric heating components and a second end that is grounded;

said first switching component is closed and said second switching component is opened so as to ground said first electric heating component and to bypass said second and third electric heating components when the constant-voltage of the battery electrically connected to said power module is equal to the first value;

said first switching component is opened and said second switching component is closed so as to bypass said third electric heating component and so that said first and second electric heating components are in series connection with said power module when the constant-voltage of the battery electrically connected to said power module is equal to the second value, and said first and second switching components are opened so that said first, second and third electric heating components are in series connection with said power module when the constant-voltage of the battery electrically connected to said power module is equal to a third value greater than the second value.

4. The electric heating apparatus as claim in claim 1, wherein said electric heating components are arranged close together and are physically parallel to each other.

5. The electric heating apparatus as claimed in claim 1, wherein said electric heating components are arranged close together, each of said electric heating components is bent to form several segments, and at least one of said segments of one of said electric heating components and one of said segments of another one of said electric heating components cross each other.

* * * * *